US005575580A

United States Patent [19]

Parrish et al.

[11] Patent Number: 5,575,580

[45] Date of Patent: Nov. 19, 1996

[54] CONNECTOR FOR STRUCTURAL APPARATUS

[75] Inventors: Terry V. Parrish; Duane R. Lundberg, both of Monett, Mo.

[73] Assignee: Miracle Recreation Equipment Company, Monett, Mo.

[21] Appl. No.: 433,158

[22] Filed: May 3, 1995

[51] Int. Cl.[6] ..... E04G 7/00; E04H 17/14; F16B 9/00; B25G 3/00

[52] U.S. Cl. ..... 403/49; 403/175; 403/230; 403/241; 403/396; 248/219.4; 248/230.1; 256/65; 256/67

[58] Field of Search ..... 403/49, 217, 230, 403/241, 170, 171, 178, 169, 174, 175, 335, 336, 385, 396, 397; 248/219.4, 230.1; 256/65, 68, 67

[56] References Cited

U.S. PATENT DOCUMENTS

| | | | |
|---|---|---|---|
| 582,170 | 5/1897 | Brown . | |
| 1,344,342 | 6/1920 | Hanson . | |
| 2,676,025 | 5/1954 | Davis . | |
| 2,850,311 | 9/1958 | Mansfield . | |
| 3,092,407 | 6/1963 | Blonder . | |
| 3,428,300 | 2/1969 | Sconzo . | |
| 3,524,627 | 8/1970 | Boyanton et al. . | |
| 4,619,545 | 10/1986 | Küttenbaum | 403/373 X |
| 4,632,221 | 12/1986 | Stanford | 403/49 X |
| 4,834,431 | 5/1989 | Calmettes et al. . | |
| 4,840,513 | 6/1989 | Hackett | 182/179 X |
| 4,880,195 | 11/1989 | Lepley | 248/219.4 |
| 4,896,454 | 1/1990 | Cronenwett et al. | 248/219.4 X |
| 4,915,535 | 4/1990 | Willetts . | |
| 5,098,051 | 3/1992 | Aldridge et al. | 248/219.4 X |
| 5,184,911 | 2/1993 | Wu | 403/385 |

*Primary Examiner*—Blair Johnson
*Assistant Examiner*—Bruce A. Lev
*Attorney, Agent, or Firm*—Polster, Lieder, Woodruff & Lucchesi, L.C.

[57] ABSTRACT

An assembly for joining a generally cylindrical member to at least one other member wherein the assembly includes a pair of oppositely disposed C-shaped connectors that when connected together are in one of two selected conditions. When in the first condition the C-shaped connectors are slidable about the surface of the generally cylindrical member and when in the second condition the C-shaped connectors are secured to the generally cylindrical member at a preselected position on the surface thereof. The assembly includes a component receiver which receives the other member. The component receiver is slidably mounted on a selected one of the C-shaped connectors so as to be in one of two conditions. When in the first condition, the component receiver is slidable on the C-shaped connectors; and when in the second condition, the component receiver is secured to the adjacent C-shaped connector.

12 Claims, 4 Drawing Sheets

CONNECTOR FOR STRUCTURAL APPARATUS

BACKGROUND OF THE INVENTION

The invention pertains to a connector assembly, and more specifically, to a connector assembly for connecting together two or more structural members.

In the past, playground equipment, especially that used for climbing and the like, comprised a plurality of vertical posts secured in the ground. Other structural members, such as cylindrical bars, were attached to these posts. Because of the fact that a plurality of structural members were connected to the vertical post, there have existed several unsatisfied needs concerning the connection of these structural members to the vertical posts.

There has been a need to provide for a single connector assembly that permits the connection of a plurality of structural members to the vertical post. By providing such a connector assembly, there will be a reduction in costs over an arrangement in which there is a need for a plurality of connectors.

There has also been a need to provide a connector assembly that permits the structural members to be connected at a selected position about the periphery of the vertical post. By providing such a connector assembly, there is an increase in the design flexibility for the playground equipment.

In addition, there has been a need to provide a connector assembly that permits the structural members to be connected to the vertical post at a selected height. By providing such a connector assembly, there is also an increase in the design flexibility for the playground equipment.

There is also a need to provide a connector assembly that permits a plurality of structural members to be connected to the post at the same height position. Again, such a feature provides for an increase in the design flexibility for the playground equipment.

Thus, it is apparent that there is a need for a connector assembly that connects together two or more structural members that satisfies the following needs: (a) a single connector assembly that permits the connection of a plurality of structural members to the vertical post, (b) a connector assembly that permits the structural members to be connected at a selected position about the periphery of the vertical post, (c) a connector assembly that permits the structural members to be connected at a selected position about the periphery of the vertical post, and (d) a connector assembly that permits a plurality of structural members to be connected to the post at the same height position.

SUMMARY OF THE INVENTION

It is an object of the invention to provide an improved connector assembly for use with a post to connect one or more structural members to the post.

It is another object of the invention to provide an improved connector assembly for use with a post to connect one or more structural members to the post wherein there is a single connector assembly that permits the connection of a plurality of structural members to the post.

It is an object of the invention to provide an improved connector assembly for use with a post to connect one or more structural members to the post wherein the structural members can be connected at a selected position about the periphery of the post.

It is an object of the invention to provide an improved connector assembly for use with a post to connect one or more structural members to the post wherein the structural members can be connected to the post at a selected height.

It is still another object of the invention to provide an improved connector assembly for use with a post to connect one or more structural members to the post wherein the structural members to be connected to the post at the same height position.

In one form thereof, the invention is an assembly for joining a generally cylindrical member to at least one other member wherein the assembly comprises a pair of oppositely disposed and detachably connected C-shaped connectors. When connected together, the C-shaped connectors are in a selected one of two conditions. When in the first condition the C-shaped connectors are movable relative to the surface of the generally cylindrical member. When in the second condition the C-shaped connectors are secured to the generally cylindrical member at a preselected position on the surface thereof.

The assembly further includes a component receiver which receives the other member. The component receiver is slidably mounted on a selected one of the C-shaped connectors. The component receiver is in one of two conditions. When in the first condition the component receiver is slidable on the C-shaped connectors. When in the second condition the component receiver is secured to the adjacent C-shaped connector.

BRIEF DESCRIPTION OF THE DRAWINGS

The following is a brief description of the drawings which form a part of this patent application.

DETAILED DESCRIPTION OF A SPECIFIC EMBODIMENT

Figure 1:
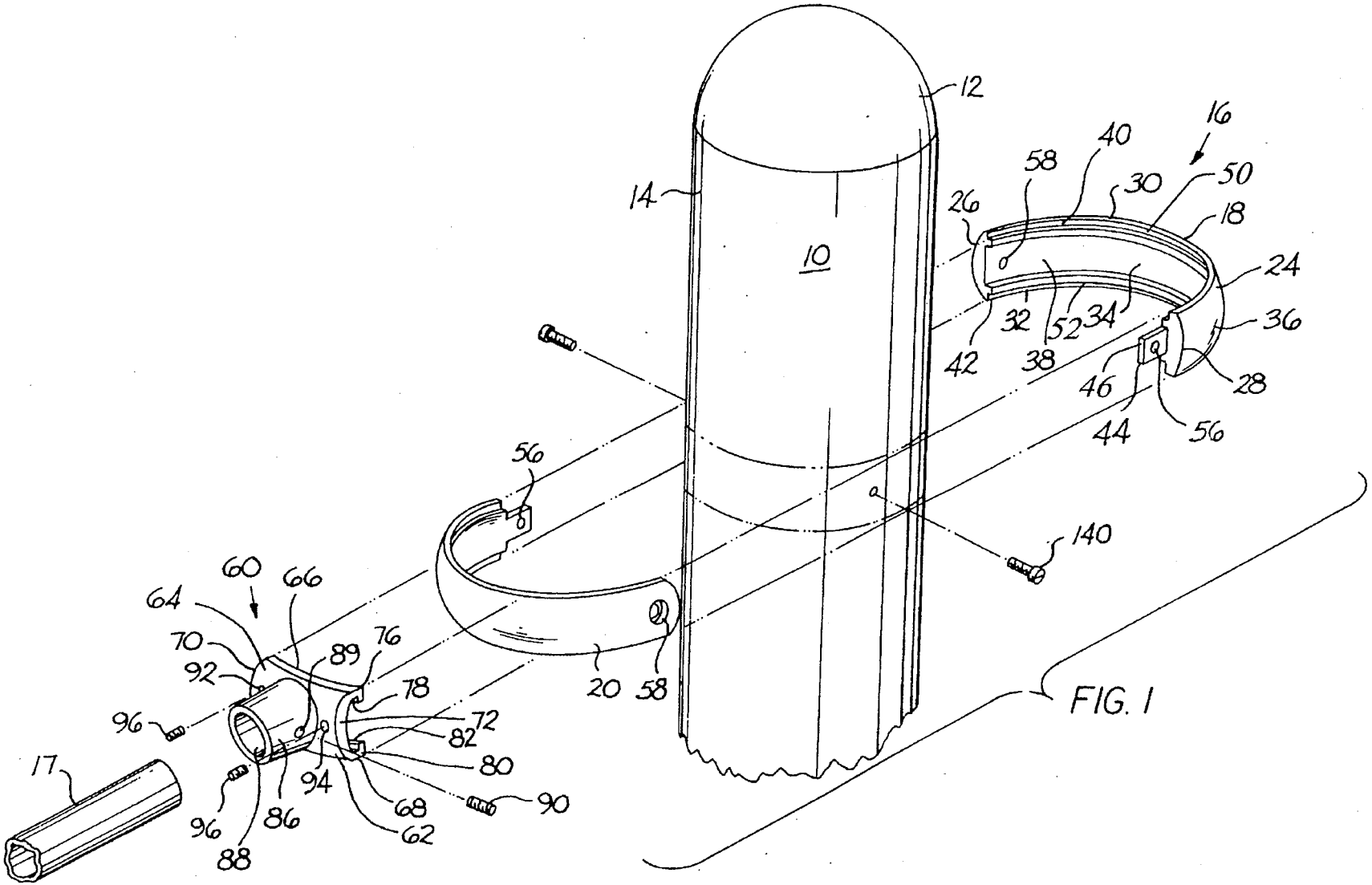
FIG. 1 is a perspective view of the top portion of the vertical post with a specific embodiment of the connector assembly exploded away from the periphery of the post.
Figure 2:
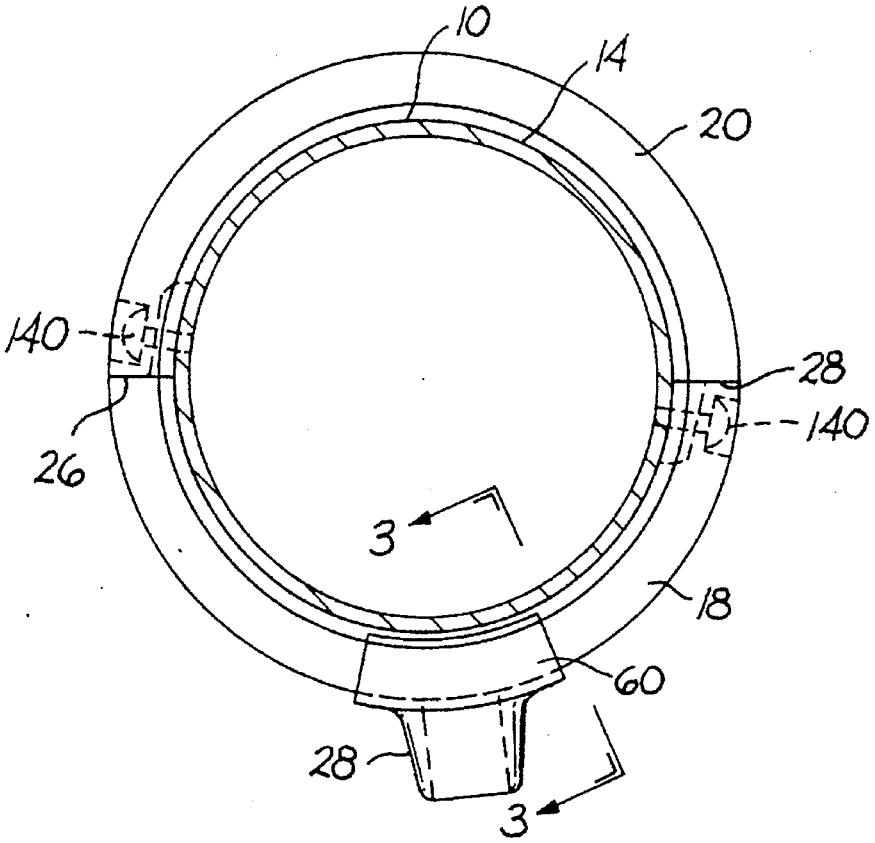
FIG. 2 is a top view of the connector assembly of FIG. 1.
Figure 3:
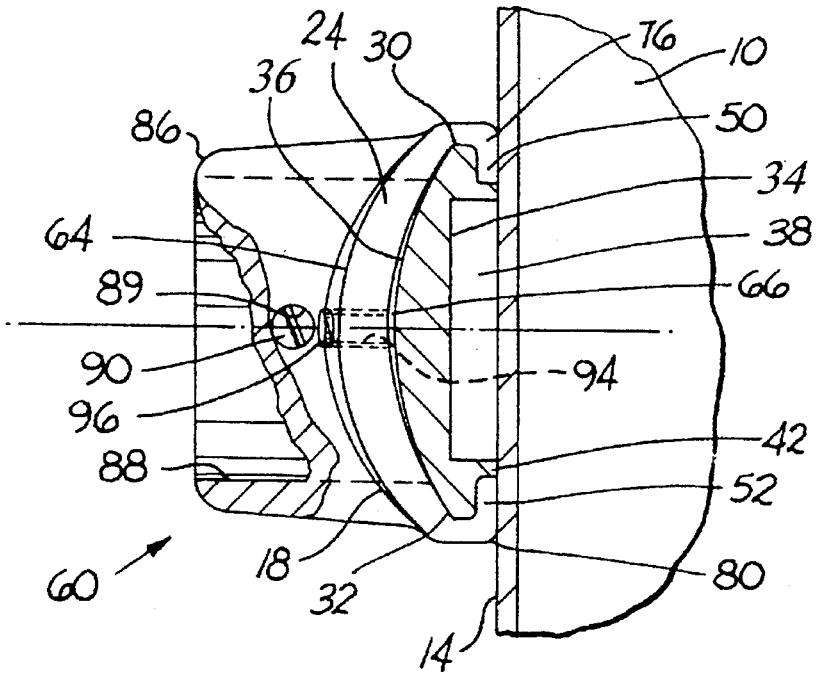
FIG. 3 is a cross-sectional view of the connector assembly of FIG. 1 taken along the section line 3—3 from FIG. 2.
Figure 4:
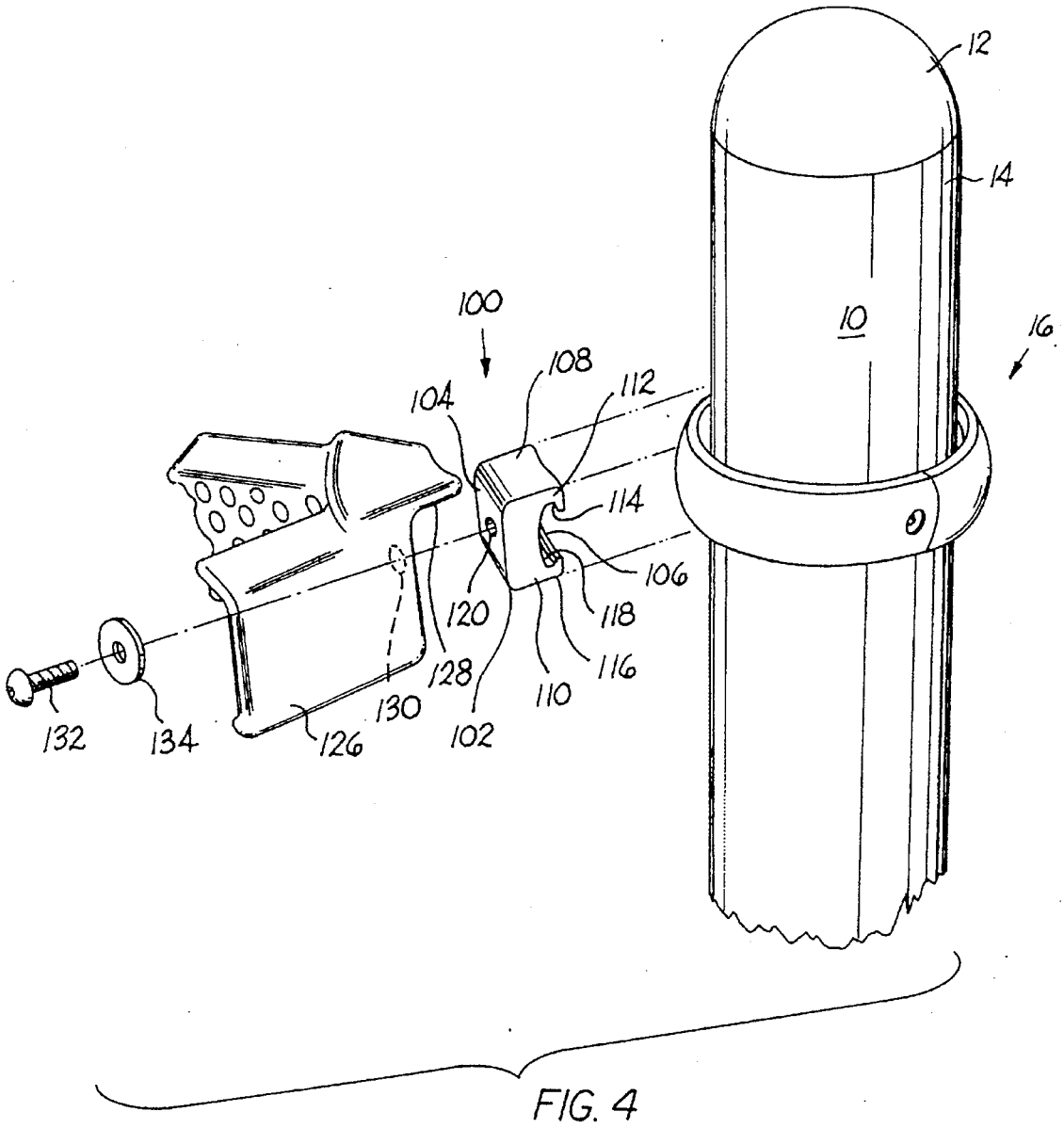
FIG. 4 is a perspective view of the top portion of the vertical post with another specific embodiment of the connector assembly exploded away from the periphery of the post.
Figure 5:
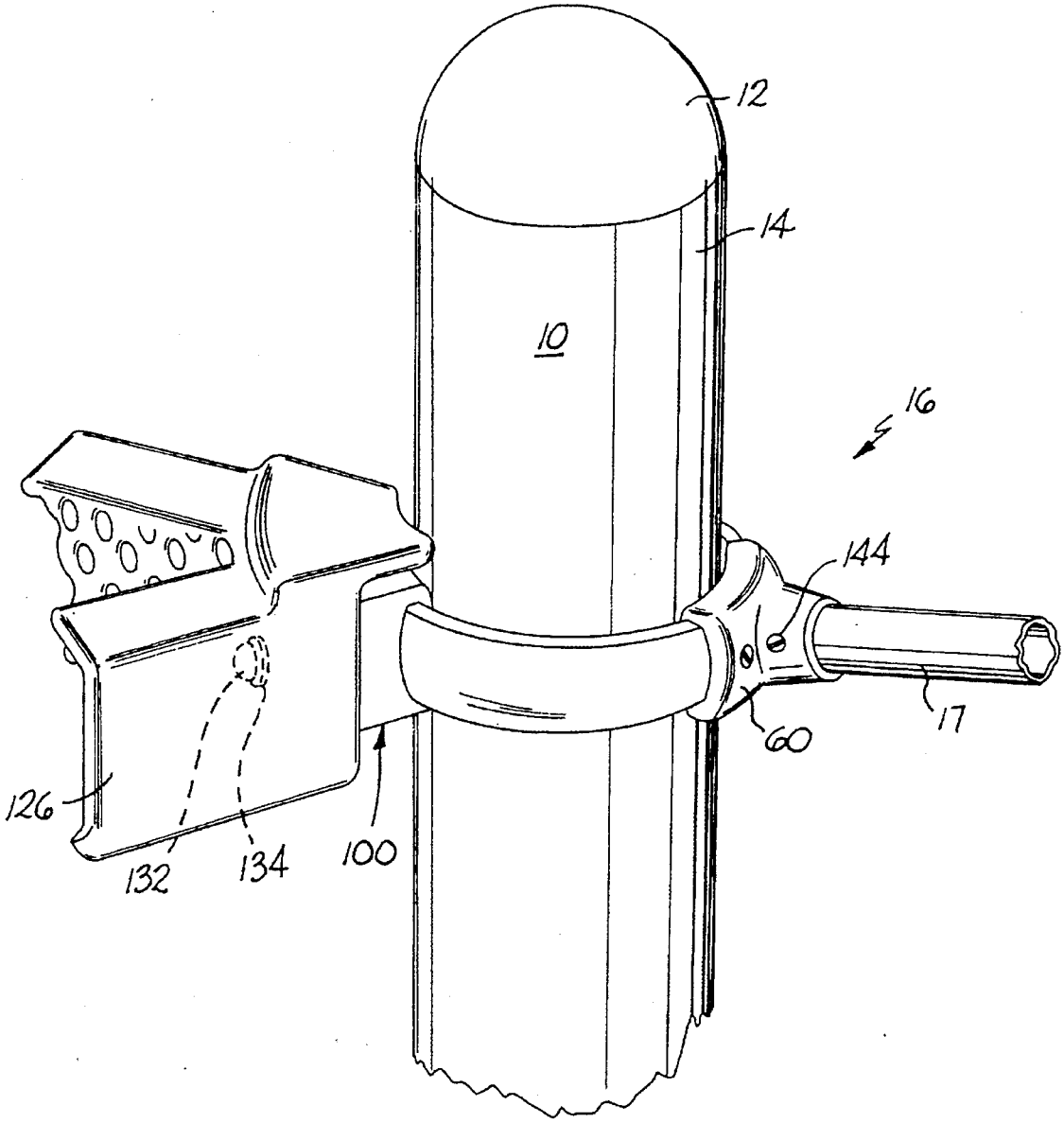
FIG. 5 is perspective view of the top portion of the vertical post with two different connectors mounted to the C-shaped connectors.

Referring to the drawings, there is shown a generally vertical post 10, which is of a generally cylindrical shape. The post 10 has a bottom end (not illustrated) which is secured to the ground. The post 10 also has a top end 12 which presents a generally semi-spherical shape. The post 10 has a peripheral surface 14 which has a generally cylindrical shape.

The drawings illustrate an assembly, generally designated as 16, for joining the vertical post 10 to another member 17. In the specific embodiment, the other member 17 is an elongate cylindrical bar. This assembly 16 includes a pair of oppositely disposed C-shaped connectors 18 and 20.

C-shaped connector 18 has a C-shaped body 24 having opposite ends (26, 28), opposite top and bottom edges (30, 32), and opposite front and rear surfaces (34, 36). The front surface 34 presents an arcuate shape in cross-section while the rear surface 36 presents a generally planar surface in cross-section.

The rear surface 36 contains a central longitudinal groove 38 for most of its length wherein the groove 38 is defined, at least in part, by a pair of oppositely disposed, spaced-apart projections 40, 42. The depth of the groove 38 decreases as the groove moves from the one end 26 to the other end 28 to where there is a tongue 44 that projects past the other end 28 of the C-shaped connector 18. The tongue 44 tapers to have a smaller dimension as it moves toward the distal end 46 thereof.

The rear surface 36 also contains a pair of peripheral grooves 50, 52 which extend along the length of the C-shaped connector 18. The depth of the grooves 50, 52 remain essentially constant along the entire length of the C-shaped connector 18. The grooves 50, 52 are defined. at least in part, by the projections 40, 42, respectively.

The tongue 44 contains an aperture 56. The C-shaped connector 18 contains an aperture 58 near the one end 26 thereof.

C-shaped connector 20 is structurally the same as C-shaped connector 18. A specific description of C-shaped connector 20 is not necessary in view of the structural similarity and the complete description of C-shaped connector 18 set forth above.

The assembly further includes a first style of component receiver 60. Component receiver 60 has an arcuate body 62 with a front surface 64, a rear surface 66, a top end 69, a bottom end 68, and opposite sides 70 and 72. Both the front and rear surfaces (64, 66) present a generally arcuate surface in cross section.

The top end 68 has an extension 76 that projects out and downwardly so as to form a channel 78 between the extension and the arcuate body 62. The bottom end 70 has an extension 80 that projects out and upwardly so as to form a channel 82 between the extension 80 and the arcuate body 62.

A generally cylindrical projection 86 extends outwardly from the front surface 64 of the component receiver 60. Projection 86 contains a bore 88. An aperture 89 passes through the side of the projection 86 so as to communicate with the bore 88. The aperture 89 receives a set screw 90.

The component receiver body 62 contains a pair of opposite apertures 92 and 94 on either side of the projection 86. Set screws 96 are adapted to pass through apertures 92 and 94 as will be described hereinafter.

The assembly further includes a second style of component receiver 100 wherein component receiver 100 comprises a body 102 with a front surface 104, a rear surface 106, a top surface 108, and a bottom surface 110. An extension 112 projects outwardly and downwardly from the top surface 108 so as to form a channel 114. An extension 116 projects outwardly and upwardly from the bottom surface 110 so as to form a channel 118.

The front surface 104 presents a planar surface while the rear surface 106 has an arcuate shape that generally corresponds to the shape of the front surface 34 of the C-shaped connectors 18. An aperture 120 passes through the central portion of the body 102.

The component receiver 100 is used to connect a foothold 126, or the like, to the vertical post 10. The foothold 126 has a rearward end 128 through an aperture 130 passes. A screw 132 is adapted to pass through a washer 134 and the aperture 130 in the foothold 126 and the aperture 120 in the body 102.

In regard to the assembly of the component receiver 100, one or more of selected ones of the component receivers 60 and 100 are positioned on a selected C-shaped connector. Although the dimensioning of the components has an influence, it is typical that the C-shaped connectors (18, 20) can accommodate up to six component receivers (60, 100). The component receiver (60, 100) is slid on either end of the C-shaped connector so that the channels 78, 82 of the component receiver 60 (or the channels 114, 118 of the component receiver 100) receive the corresponding peripheral grooves 50, 52 respectively.

The C-shaped connectors 18, 20, with the component receivers mounted thereon, are then positioned about the circumference of the vertical port 10 so that the tongue 44 of each one of the C-shaped connectors is received in the groove 38 of the opposite C-shaped connector at the other end 28 thereof. The self-drilling screws 140 are then passed through the apertures 56 and 58 in the tongue 44 and the body 24, respectively, thereby fastening C-shaped connectors 18 and 20 firmly to the vertical post 10.

The component receivers 60, 100 may then be positioned to a selected position on the periphery of the vertical post 10. In the case of component receiver 60, the set screws 96 are inserted into component receiver 60 through apertures 92 and 94 and tightened against C-shaped connectors 18 and 20 holding component receiver 60 firmly to the C-shaped connectors 18, 20, and a result, also to the vertical post 10. Appropriate other structural members can then be attached to the component receivers. For example, in the case of component receiver 60, the cylindrical bar may be inserted into the cylindrical bore and secured thereto by set screws 144 or the like.

In the case of the component receiver 100, the foothold is connected to the component receiver 100 by the screw 132 which passes through the washer 134 and the apertures in the foothold and the component receiver so that the screw 132 is firmly tightened against the C-shaped connectors (18, 20) holding the component receiver 100 firmly to the C-shaped connectors, and as a result, to the vertical post 10.

It can be readily seen that the present invention provides a connectors assembly that connects together two or more structural members. The connectors assembly mounts to a vertical post in such a fashion that the vertical height of the connectors assembly is adjustable. The connectors assembly also permits more than one other structural member to be connected thereto by only one connector assembly. The connector assembly further permits the selective positioning of the other structural members about the periphery of the vertical post. All of these features provide for an improved connector assembly that provides for improved design flexibility.

Having described the presently preferred specific embodiments of the present invention, it is understood that the invention may be otherwise embodied within the scope of the following claims.

What is claimed is:

1. An assembly for joining a generally cylindrical member having a generally cylindrically shaped surface to at least one other member, the assembly comprising:

a pair of oppositely disposed C-shaped connectors, said C-shaped connectors being detachably connected in a selected one of two conditions, when in the first condition the C-shaped connectors are movable relative to the surface of the generally cylindrical member and when in the second condition the C-shaped connectors are secured to the generally cylindrical member at a preselected position on the surface thereof, each C-shaped connector including a generally C-shaped body, the body having opposite interior and exterior surfaces and opposite ends, a pair of spaced apart protrusions project radially inwardly from the interior surface of the body so as to define a recess therebetween at the one end of the body, a tongue extending from the other end of the body, the C-shaped connectors being connected together, such that the tongue of each C-shaped connector is received in the recess of the other C-shaped connector in order that the C-shaped connectors present a generally circular shape; and a component receiver which receives the other member, the component receiver being slidably mounted on a selected one of the C-shaped connectors, and the component receiver being in one of two conditions, when in the first condition the component receiver is slidable on the C-shaped connectors and when in the second condition the component receiver is secured to the adjacent C-shaped connector.

2. The assembly of claim 1 wherein the component receiver includes a generally arcuate body having front and rear surfaces and a pair of longitudinal edges, a lip extends from each of the longitudinal edges so as to define a oppositely disposed slots between the lip and the portion of the rear surface of the body.

3. The assembly of claim 2 wherein the body of each one of the C-shaped connectors has opposite edges, and the opposite slots of the component receiver receiving a portion of the C-shaped body adjacent the opposite arcuate edges.

4. The assembly of claim 2 wherein a generally cylindrical portion projects outwardly from the exterior surface of the component receiver, and the generally cylindrical portion having a bore which is receivable of the other structural member.

5. The assembly of claim 2 wherein a portion of the exterior surface of the component receiver presents a generally flat surface, a threaded aperture passes through the body in the region of the flat surface, and a screw engaging the treads of the threaded portion.

6. The assembly of claim 1 wherein the body of the component receiver further contains a threaded aperture passing therethrough; a set screw engaging the treads of the aperture, and the set screw being either a fastened condition or an unfastened condition; when in the fastened condition, the set screw engages the exterior surface of the proximate C-shaped connector; and when in the unfastened condition, the set screw does not engage the exterior surface of the proximate C-shaped connector.

7. The assembly of claim 1 wherein when in the first condition, the C-shaped connectors are radially movable relative to the surface of the post and vertically movable relative to the surface of the post.

8. An assembly for joining a generally cylindrical member to at least one other member, the assembly comprising:

a pair of oppositely disposed C-shaped connectors, said C-shaped connectors being detachably connected, when connected together the C-shaped connectors being in a selected one of two conditions wherein when in the first condition the C-shaped connectors are movable relative to the surface of the generally cylindrical member and when in the second condition the C-shaped connectors are secured to the generally cylindrical member at a preselected position on the surface thereof, a first component receiver which receives one other member, the first component receiver being slidably mounted on a selected one of the C-shaped connectors, and the first component receiver being in one of two conditions, when in the first condition the first component receiver is slidably on the C-shaped connectors and when in the second condition the first component receiver is secured to the adjacent C-shaped connector, the first component receiver including a generally arcuate body having front and rear surfaces and a pair of longitudinal edges, a lip extends from each of the longitudinal edges so as to define oppositely disposed slots between the lip and the portion of the rear surface of the body, and a second component receiver which receives one other member, the second component receiver being slidably mounted on a selected one of the C-shaped connectors, and the second component receiver being in one of two conditions wherein when in the first condition the second component receiver is slidable on the C-shaped connectors and when in the second condition the second component receiver is secured to the adjacent C-shaped connector.

9. The assembly of claim 8 wherein when in the first condition, the C-shaped connectors are radially movable relative to the surface of the post and vertically movable relative to the surface of the post.

10. An assembly of structural members comprising:

a vertical post having a distal end, a pair of oppositely disposed C-shaped connectors, said C-shaped connectors being detachably connected in a selected one of two conditions, when in the first condition the C-shaped connectors are movable relative to the surface of the post and when in the second condition the C-shaped connectors are secured to the post at a preselected position on the surface thereof, and each C-shaped connector including a generally C-shaped body with interior and exterior surfaces and opposite ends, the pair of C-shaped connectors also having complementary interfitting connections for assembling the pair of C-shaped connectors together to define a generally circular shape;

a component receiver which receives the other member, the component receiver being slidably mounted along a C-shaped path corresponding to a selected one of the C-shaped connectors, and the component receiver being in one of two conditions, when in the first condition the component receiver is slidable on the C-shaped connectors and when in the second condition the component receiver is secured to the adjacent C-shaped connector.

11. The assembly of claim 10 wherein when in the first condition, the C-shaped connectors are radially movable relative to the surface of the post and vertically movable relative to the surface of the post.

12. The assembly of claim 10 wherein the complementary interfitting connections associated with the pair of C-shaped connectors include tongue and recess connections.

* * * * *